US011649554B2

(12) United States Patent
Horikawa et al.

(10) Patent No.: US 11,649,554 B2
(45) Date of Patent: May 16, 2023

(54) METHOD FOR PRODUCING METAL TITANIUM

(71) Applicant: Toho Titanium Co., Ltd., Kanagawa (JP)

(72) Inventors: Matsuhide Horikawa, Kanagawa (JP); Daisuke Suzuki, Kanagawa (JP); Haruka Yamamoto, Kanagawa (JP); Hideki Fujii, Kanagawa (JP)

(73) Assignee: Toho Titanium Co., Ltd., Kanagawa (JP)

( * ) Notice: Subject to any disclaimer, the term of this patent is extended or adjusted under 35 U.S.C. 154(b) by 0 days.

(21) Appl. No.: 17/267,572

(22) PCT Filed: Jul. 18, 2019

(86) PCT No.: PCT/JP2019/028327
§ 371 (c)(1),
(2) Date: Feb. 10, 2021

(87) PCT Pub. No.: WO2020/044841
PCT Pub. Date: Mar. 5, 2020

(65) Prior Publication Data

US 2021/0310140 A1 Oct. 7, 2021

(30) Foreign Application Priority Data

Aug. 31, 2018 (JP) ..... JP2018-162961

(51) Int. Cl.

| | |
|---|---|
| ***C25C 5/04*** | (2006.01) |
| ***C25C 7/06*** | (2006.01) |
| ***C25C 3/28*** | (2006.01) |
| ***C25C 7/02*** | (2006.01) |
| ***C25C 7/08*** | (2006.01) |

(52) U.S. Cl.
CPC ..... *C25C 3/28* (2013.01); *C25C 7/025* (2013.01); *C25C 7/08* (2013.01)

(58) Field of Classification Search
CPC .... C25C 3/28; C25C 5/04; C25C 3/00; C25C 7/005; C25C 3/26; C25C 7/06; C25C 1/00; C25C 7/08; C25C 7/00
See application file for complete search history.

(56) References Cited

U.S. PATENT DOCUMENTS

| | | | | |
|---|---|---|---|---|
| 3,662,047 | A | 5/1972 | Tokumoto et al. | |
| 4,521,281 | A * | 6/1985 | Kadija | C25C 3/28 204/263 |
| 2016/0222533 | A1 * | 8/2016 | Zhu | C25C 3/28 |

FOREIGN PATENT DOCUMENTS

| | | | |
|---|---|---|---|
| CN | 106757167 | A | 5/2017 |
| JP | 31-701 | B1 | 2/1956 |
| JP | 31-6802 | B1 | 8/1956 |
| JP | 31-8007 | B1 | 9/1956 |
| JP | S4828538 | B1 | 9/1973 |
| JP | H3-177594 | A | 8/1991 |
| JP | H6173065 | A | 6/1994 |
| JP | 2017-137551 | A | 8/2017 |

OTHER PUBLICATIONS

Search Report in International Application No. PCT/JP2019/028327 dated Sep. 3, 2019, 4 pages.
International Preliminary Report on Patentability and Written Opinion in International Application No. PCT/JP2019/028327 dated Mar. 11, 2021, 9 pages.

* cited by examiner

*Primary Examiner* — Zulmariam Mendez
(74) *Attorney, Agent, or Firm* — Marshall, Gerstein & Borun LLP

(57) ABSTRACT

A method for producing metal titanium by carrying out electrolysis using an anode and a cathode in a molten salt bath, the method using an anode containing metal titanium as the anode, the method comprising a titanium deposition step of depositing metal titanium on the cathode, wherein, in the titanium deposition step, a temperature of the molten salt bath is from 250° C. or more and 600° C. or less, and an average current density of the cathode in a period from the start to 30 minutes later of the titanium deposition step is maintained in a range of 0.01 A/cm$^2$ to 0.09 A/cm$^2$.

12 Claims, No Drawings

METHOD FOR PRODUCING METAL TITANIUM

FIELD OF THE INVENTION

The present invention relates to a method for producing metal titanium by performing electrolysis by applying a voltage between an anode and a cathode in a molten salt bath. More particularly, the present invention proposes a technique of improving an ability of metal titanium electrodeposited on the cathode to be separated from the cathode.

BACKGROUND OF THE INVENTION

Metal titanium is generally produced by a Kroll process suitable for mass production. In the Kroll process, titanium oxide contained in titanium ores is firstly allowed to react with chlorine to produce titanium tetrachloride. The titanium tetrachloride is then reduced with metal magnesium to obtain sponge-shaped metal titanium, so-called sponge titanium.

Here, in order to produce metal titanium in the form of a sheet such as a foil having a relatively lower thickness, it is necessary to melt the above sponge titanium and cast it into a titanium ingot or titanium slab, and then subject it to forging, rolling or other processing. Therefore, with such a process requiring melting and processing, it cannot be said that metal titanium having a predetermined shape such as a foil or a sheet can be produced efficiently and at low cost.

Under such circumstances, the use of molten salt electrolysis for depositing metal titanium with a molten salt bath in place of the above melting and processing is attracting attention in terms of reducing energy consumption and cost in the producing process.

Examples of the relevant technique include those described in, for example, Patent Literature 1 and the like. Patent Literature 1 describes "a method for producing a metal titanium foil according to a molten salt electrolysis method, wherein at least a titanium electrodeposition surface of a cathode electrode is made of metal molybdenum or metal silicon, and a molten salt bath contains titanium ions dissolved in a chloride of an alkali metal or a mixed salt of a chloride or iodide of an alkali metal. It also discloses that this can allow "a smooth titanium foil to be directly obtained, which eliminates steps such as hot forging and hot rolling, so that the steps can be reduced and a yield can be improved, and a titanium foil having a low oxygen concentration (1000 ppm or less) and a low iron concentration (2000 ppm or less) that are levels of industrial pure titanium can be obtained at low cost".

CITATION LIST

Patent Literatures

[Patent Literature 1] Japanese Patent Application Publication No. 2017-137551 A

SUMMARY OF THE INVENTION

Technical Problem

By the way, the molten salt electrolysis in which electrolysis is performed based on the application of a voltage between an anode and a cathode in a molten salt bath requires deposition of metal titanium on the cathode, followed by separation of the metal titanium from the cathode. In particular, if an attempt is made to industrially utilize the production of metal titanium by such molten salt electrolysis, a problem of an ability of metal titanium to be separated from the cathode would become apparent due to increased areas of front and back surfaces of the metal titanium in the form of a sheet.

In this regard, although Patent Literature 1 discusses that the metal titanium having a smooth surface is deposited on the cathode, the separation of metal titanium from the cathode remains to be studied. Patent Literature 1 discloses that "the immersed portion of the cathode electrode has a width of 10 mm and a depth of 10 mm" (paragraph [0031]), and metal titanium having a relatively small size is deposited. Therefore, in order to apply this technique to mass production that requires the deposition of metal titanium having a certain large size, there would be a need for further improvement in terms of the ability of metal titanium to be separated from the cathode.

Further, in Patent Literature 1, the electrolysis is carried out in the molten salt bath at a temperature of 700° C. or more. However, it has been found that that the molten salt bath at the higher temperature may cause deterioration of the ability of metal titanium to be separated from the cathode.

An object of the present invention is to provide a method for producing metal titanium, which can satisfactorily separate metal titanium deposited on a cathode by molten salt electrolysis.

Solution to Problem

As a result of intensive studies, the present inventors have found that by maintaining the molten salt bath at a relatively low temperature and setting an average current density of the cathode for 30 minutes after the start of titanium deposition step to a predetermined range, the resulting metal titanium deposited on the cathode can be easily separated.

The method for producing metal titanium according to the present invention is a method for producing metal titanium by carrying out electrolysis using an anode and a cathode in a molten salt bath, the method using an anode containing metal titanium as the anode, the method comprising a titanium deposition step of depositing metal titanium on the cathode, wherein, in the titanium deposition step, a temperature of the molten salt bath is from 250° C. or more and 600° C. or less, and an average current density of the cathode in a period from the start to 30 minutes later of the titanium deposition step is maintained in a range of 0.01 $A/cm^2$ to 0.09 $A/cm^2$.

Here, it is preferable that in the titanium deposition step, a surface area of a cathode immersed portion that is immersed in the molten salt bath is 3000 $mm^2$ or more.

Further, it is preferable that a surface of the cathode on which metal titanium is deposited in the titanium deposition step has a curved surface shape.

In this case, it is more preferable that the cathode has a cylindrical shape.

Further, it is also preferable that the molten salt bath contains at least two selected from the group consisting of $MgCl_2$, NaCl, KCl, $CaCl_2$, LiCl, alkali metal iodides, and alkali metal bromides.

The cathode may contain 70% by mass or more of Ti, Mo or Fe.

The method for producing metal titanium according to the present invention can further comprise an anode dissolving step of dissolving the anode by electrolysis in the molten salt bath prior to the titanium deposition step.

The method for producing metal titanium according to the present invention can further comprise a titanium separation step of separating the metal titanium deposited on the cathode from the cathode after the titanium deposition step.

The method for producing metal titanium according to the present invention is particularly suitable for producing metal titanium in the form of a sheet having a thickness of from 20 μm to 1000 μm.

Advantageous Effects of Invention

According to the method for producing metal titanium of the present invention, the titanium deposition step is carried out at the temperature of the molten salt bath of from 250° C. or more and 600° C. or less while maintaining the average current density of the cathode in a period of the start to 30 minutes later of the titanium deposition step in the range of from 0.01 $A/cm^2$ to 0.09 $A/cm^2$, whereby the metal titanium deposited on the cathode by molten salt electrolysis can be satisfactorily separated.

DETAILED DESCRIPTION OF THE INVENTION

Hereinafter, embodiments according to the present invention will be described in detail.

A method for producing metal titanium according to an embodiment of the present invention is to produce metal titanium by molten salt electrolysis which carries out electrolysis using an anode and a cathode in a molten salt bath. The production method includes a titanium deposition step of depositing metal titanium on the cathode by the electrolysis using the molten salt bath.

In the titanium deposition step, melting salts in an electrolytic bath is generally brought into a molten state to make a molten salt bath. In the molten salt bath, the anode and cathode each connected to a power source are immersed, and a voltage is applied between the anode and the cathode to carry out electrolysis. More particularly, in the titanium deposition step, it is important that a temperature of the molten salt bath is a relatively low temperature of 250° C. or more and 600° C. or less, and an average current density of the cathode from the start to 30 minutes later of the titanium deposition step is maintained in a range of from 0.01 $A/cm^2$ to 0.09 $A/cm^2$. These can allow metal titanium to be easily peeled off from the cathode in the subsequent titanium separation step.

(Molten Salt Bath)

Melting salts for forming the molten salt bath in the electrolytic bath are generally a mixture of multiple types of halides. Typical halides include chlorides such as $MgCl_2$, NaCl, KCl, $CaCl_2$ and LiCl, bromides of alkali metals such as KBr, and iodides of alkali metals such as LiI, CsI and K1. The containing of two or more of them can allow a molten state of the molten salt bath to be satisfactorily maintained even at a low temperature to some extent, so that the above-mentioned low temperature range of the molten salt bath in the titanium deposition step can be easily achieved.

The content of the alkali metal iodide in the molten salts may be 50 mol % or more, or further 85 mol % or more. According to such a composition mainly based on the alkali metal iodide, the temperature of the molten salt during electrolysis can be sufficiently decreased to 250° C. to 400° C., for example.

The molten salt bath may contain at least two selected from the group consisting of $MgCl_2$, NaCl, KCl, $CaCl_2$, LiCl, alkali metal iodides, and alkali metal bromides.

Particularly, the molten salt bath may have a composition containing at least two selected from the group consisting of $MgCl_2$, NaCl, KCl, $CaCl_2$ and LiCl. In this case, the temperature of the molten salt bath can be 400° C. or more and 600° C. or less, or 400° C. or more and 550° C. or less. In this case, the total content of at least two selected from the group consisting of $MgCl_2$, NaCl, KCl, $CaCl_2$ and LiCl in the molten salt bath may be 80 mol % or more.

However, for the above halides such as chlorides, their specific types and contents of the salts can be appropriately determined in view of the operating temperature and the like. The content on mole basis as described above is measured by ICP emission spectrometry.

By containing chlorides or the like as described above, the molten salt bath can have a low melting point (eutectic point), such as 130° C. to 480° C. This can allow the temperature of the molten salt bath during electrolysis, which will be described later, to be lowered.

It is also possible to allow a titanium raw material to be present in the molten salt bath in advance before the start of electrolysis so as to contain previously a titanium raw material such as titanium halide in the molten salt bath. In the titanium deposition step, metal titanium is deposited on the cathode. When the titanium raw material is previously mixed in the molten salt bath, examples of the titanium raw material include titanium halide, more particularly, $TiCl_2$ and $TiI_2$, and/or low-purity metal titanium containing impurities such as titanium scrap and titanium sponge. Among them, the metal titanium containing impurities may, for example, contain a relatively large amount of Fe and O as impurities. When the titanium scrap or sponge titanium is used as the titanium raw material, these may be brought into contact with $TiCl_4$ to produce titanium subchloride. In this embodiment, the titanium raw material is dissolve d in the molten salt bath before depositing the metal titanium on the cathode, so that Fe and O can be decreased during the deposition even if the titanium raw material contains a relatively large amount of Fe and O.

When $TiCl_2$ or the like is previously mixed in the molten salt bath, the content of $TiCl_2$ in the molten salt bath is preferably maintained in a range of from 3 mol % to 12 mol %, especially in a range of from 5 mol % to 12 mol %. In such a range, the titanium deposition step can be started without waiting for sufficient dissolution of the anode, and metal titanium can be satisfactorily deposited.

However, when an anode dissolving step as described later is carried out, the titanium raw material, which is a raw material of the metal titanium deposited on the cathode, would be fed to the molten salt bath due to the dissolution of the anode containing metal titanium. This can allow the metal titanium to be deposited on the cathode in the subsequent titanium deposition step. In this case, it is not always necessary to mix $TiCl_2$ or the like in the molten salt bath in advance.

(Electrolysis Apparatus)

An electrolytic bath of an electrolysis apparatus used in the molten salt electrolysis can employ a general bath such as a vessel that can be used in ordinary molten salt electrolysis and store the molten salt bath.

Here, among the anode and the cathode to be immersed in the molten salt bath in the electrolytic bath, the anode contains metal titanium. Examples of the anode that can be used include titanium sponge, a titanium rod and/or a titanium plate. When using the sponge titanium as the anode, the sponge titanium is placed in a Ni cage and a current is applied to the Ni cage, whereby only Ti can be dissolved as the anode without dissolving Ni, because Ni has a lower ionization tendency than that of Ti.

Further, examples of the cathode that can be used include cathodes made of various materials in which metal titanium is electrodeposited on their surfaces in the titanium deposition step as described later. More particularly, the cathode preferably contains 70% by mass or more of Ti, Mo or Fe. For example, the cathode may contain at least one selected from the group consisting of metal molybdenum, metal titanium, stainless steel and carbon steel. Since these materials are difficult to be dissolved into Ti at 600° C. or less, they do not adhere to the metal titanium deposited on the cathode, so that the metal titanium can be easily separated, and contamination of impurities into the metal titanium can be suppressed. Such effects can be obtained if at least the surface of the cathode is made of metal molybdenum, metal titanium, stainless steel and/or carbon steel by coating or the like. However, in addition to these, the cathode may employ a carbon electrode such as graphite and glassy carbon.

When the anode dissolving step as described later is carried out, the cathode can be replaced prior to the subsequent titanium deposition step. Since metals other than Ti may be deposited on the cathode in the anode dissolving step, the titanium deposition step carried out using the cathode in that state leads to decreased purity of the resulting metal titanium. Also, the deposited Ti may be alloyed to reduce the separability. Therefore, it is preferable to replace the cathode after feeding the titanium raw material to the molten salt bath in the anode dissolving step.

Further, as a shape of the cathode, it is preferable that at least a part of the surface on which the metal titanium is to be electrodeposited has a curved surface shape. When both the anode surface and the cathode surface have the curved surface shape, particularly a cylindrical shape, a distance between the electrodes can be easily kept constant, so that metal titanium can be more uniformly deposited over a wider area. From this viewpoint, it is preferable that the anode surface and the cathode surface have the curved surface shapes similar to each other. On the other hand, when both the anode surface and the cathode surface have a flat plate shape, the sneak current into the back side of the plate or the concentration of the current at the corners may occur, resulting in variations in the thickness of the deposited metal titanium.

Further, for example, the cylindrical surface layer side of the cathode made by forming the entire cathode into a shape of a rod having a circular cross-section as a so-called roll-shaped electrode can allow metal titanium to be continuously produced, which is advantageous in view of productivity. The cylindrical shape of the cathode means that a portion where the metal titanium is deposited has the cylindrical shape. Therefore, even if the rod-shaped cathode having a circular cross-section is used, it corresponds to the cylindrical cathode. In this case, for example, operations of immersing a cylindrical cathode in the molten salt bath while rotating the cylindrical cathode around its central axis to electrodeposit metal titanium, and then lifting it up from the molten salt bath and separating the metal titanium electrodeposited on the surface can be continuously carried out, thereby continuously producing long metal titanium.

(Anode Dissolving Step)

As described above, when the titanium raw material such as titanium chloride is not mixed in the molten salt bath in advance, an anode dissolving step of dissolving the anode by electrolysis in the molten salt bath can be carried out prior to the titanium deposition step. When the titanium raw material is separately mixed in the molten salt bath in advance, the anode dissolving step may be omitted, but the anode dissolving step may be further carried out.

In the anode dissolving step, as with substantially the same as general molten salt electrolysis, an appropriate magnitude of current is passed between the anode and the cathode immersed in the molten salt bath while maintaining the molten salt bath at a predetermined temperature.

This allows the anode containing metal titanium to be dissolved in the molten salt bath, whereby the raw material of metal titanium deposited on the cathode is fed to the molten salt bath. That is, here, the anode functions to feed the titanium raw material to the molten salt bath, like a so-called consumable electrode.

The temperature of the molten salt bath in the anode dissolving step can be from 250° C. to 600° C., and an average current density of the cathode can be from 0.01 $A/cm^2$ to 2.00 $A/cm^2$. These can allow the anode to be successfully dissolved.

Here, the average current density of the cathode can be calculated by the equation: average current density ($A/cm^2$)=average current (A)/electrolytic area ($cm^2$). Here, for example, in the case of the cylindrical cathode, the electrolytic area is calculated by the equation: electrolytic area ($cm^2$)=cathode immersed surface area=cathode diameter (cm)×3.14×cathode height (cm). Further, the average current is an average value of currents flowing at a predetermined time required for determining the average current density. In the anode dissolving step, it is an average value of the currents applied in all the steps. In the titanium deposition step as described later, an average value of the currents applied from the start to 30 minutes later of that step is used.

(Titanium Deposition Step)

After the anode dissolving step as described above, the cathode can be replaced as needed, and a titanium deposition step can be carried out. If the anode dissolving step is omitted, the titanium deposition step can be carried out immediately after the electrolytic bath is made as the molten salt bath.

In the titanium deposition step, the applying of voltage between the anode and the cathode deposits titanium on the cathode in the molten salt bath as metal titanium. Metals other than metal titanium may be electrodeposited on the cathode in the above anode dissolving step. Therefore, by replacing the cathode after the anode dissolving step and before the titanium deposition step, metal titanium having higher purity can be produced.

In the titanium deposition step, a temperature of the molten salt bath is 250° C. or more and 600° C. or less, and an average current density of the cathode from the start to 30 minutes later of the titanium deposition step is maintained in a range of from 0.01 $A/cm^2$ to 0.09 $A/cm^2$.

The temperature of the molten salt bath of 250° C. or more can allow a good molten state of the molten salt bath to be maintained. The temperature of the molten salt bath of 600° C. or less can allow the separability of the metal titanium from the cathode to be improved, because between the deposited metal titanium and the cathode, it is difficult to form alloys made of these metals. Further, it can allow an increase in cost due to the higher temperature to be suppressed.

The average current density of the cathode of 0.01 $A/cm^2$ or more leads to a good titanium deposition amount. The average current density of the cathode of 0.09 $A/cm^2$ or less can lead to improved separability of metal titanium. The good separability can be exhibited by maintaining the average current density in a period from the start to 30 minutes later of the titanium deposition step (hereinafter, also referred to as "deposition start period") in the above range. Here, the start of the titanium deposition step means a time when the deposition of metal titanium on the cathode is started.

From this point of view, the temperature of the molten salt bath is more preferably 250° C. or more and 550° C. or less. Further, it is more preferable to maintain the average current density in the period from the start to 30 minutes later of the titanium deposition step in the range of from 0.04 $A/cm^2$ to 0.09 $A/cm^2$.

After the deposition start period has elapsed, the average current density of the cathode can be 0.01 $A/cm^2$ to 5.00 $A/cm^2$. After the deposition start period has elapsed, the upper limit side of the average current density of the cathode may be 2.00 $A/cm^2$ or less.

In the titanium deposition step, a steady current can be used when metal titanium is deposited on the cathode by electrolysis, but an ON/FF controlled pulse current may be used. The ON/OFF controlled pulse current means that the supply of the current for depositing the metal titanium and the stop of the supply of the current are alternately repeated. Switching to current values at three or more steps may be repeated. The use of the ON/OFF controlled pulse current eliminates or alleviates a non-uniformity of the Ti concentration by the diffusion at the stop of the supply of the current. As a result, it is considered that metal titanium having higher purity can be obtained.

Alternatively, it is also possible to use a gradient current. The gradient current means that an amount of current is increased or decreased, or the increasing and decreasing of the amount of current are alternately carried out, over time. The degree of the increase or decrease can be changed in the middle.

When such a pulse current or gradient current is adopted, the average current density of the cathode can be obtained in the same method as the calculation method as described above.

Here, a surface area of a cathode immersed portion (i.e., a contact area between the molten salt bath and the surface of the cathode), which is a portion of the cathode immersed in the molten salt bath, is 3000 $mm^2$ or more, or further 4000 $mm^2$ or more, and more preferably 6000 $mm^2$ or more, and more particularly 8000 $mm^2$ or more. This can result in large sheet-shaped metal titanium having higher surface areas on the front and back surfaces.

(Titanium Separation Step)

After the titanium deposition step, a titanium separation step is carried out to separate the metal titanium deposited on the cathode from the cathode.

Here, various methods for separating the metal titanium can be employed. For example, a way (mechanical peeling) to grip a part of metal titanium and physically peel off the metal titanium from the cathode can be employed.

In this embodiment, as described above, a temperature of the molten salt bath is 250° C. or more and 600° C. or less, especially in the titanium deposition step, and an average current density of the cathode in a period from the start to 30 minutes later of the titanium deposition step is maintained in a range of from 0.01 $A/cm^2$ to 0.09 $A/cm^2$, whereby, even if the metal titanium is relatively large sheet-shaped metal titanium having higher front and back surface area, it can be easily separated from the cathode.

The metal titanium thus produced is preferably in the form of a sheet, more preferably in the form of a foil, and can have a thickness of, for example, from about 20 μm to 1000 μm. The lower limit side of the thickness can be 60 μm or more. To calculate the thickness of the metal titanium, a cross section in the thickness direction is observed along one side of the sheet with an optical microscope at magnifications of 100 times, the thicknesses are determined at 10 points, and an average value thereof is determined to be the thickness of metal titanium. A longer electrolysis time tends to produce thicker metal titanium.

Further, in this embodiment, even if the metal titanium is sheet-shaped metal titanium having a larger size, for example, having an area on front and back surfaces of from about 100 $mm^2$ to about 10000 $mm^2$, it can be effectively produced by satisfactorily separating it from the cathode.

Further, since the metal titanium is produced by depositing it on the surface of the cathode by electrolysis as described above, the contents of oxygen and iron that can be contained in the metal titanium thus produced can be less than those contained in the titanium raw material of the anode and the like. For example, in the metal titanium produced according to this embodiment, the oxygen content can be reduced to 300 ppm by mass or less. Further, the iron content of the metal titanium can be reduced to 300 ppm by mass or less.

EXAMPLES

Next, the method for producing metal titanium according to present invention was experimentally conducted and its effects were confirmed as described below. However, the description herein is merely for the purpose of illustration and is not intended to be limited thereto.

(Before Electric Conduction)

In a cylindrical Ni crucible having an inner diameter of 106 mm and a height of 350 mm were placed 725 g of NaCl (special grade manufactured by Kanto Chemical Co., Inc., which was vacuum-dried at 200° C. for one day in advance), 616 g of KCl (special grade manufactured by Kanto Chemical Co., Inc., which was vacuum-dried at 200° C. for one day in advance), and 1967 g of $MgCl_2$ (anhydrous $MgCl_2$ which was by-product in the reduction step of the Kroll process). These materials were melted by increasing the temperature to 700° C. with an external heater, and used as a molten salt bath.

The temperature of the molten salt bath was then decreased to 520° C. except for Comparative Example 3, and this temperature was maintained during the subsequent electric conduction. Before electric conduction, a mixture of titanium sponge with $TiCl_4$ was mixed with the molten salt bath, thereby feeding 6 mol % of Ti to the molten salt bath. All of these operations were carried out in an Ar atmosphere.

(After Electric Conduction)

Used as the anode was a metal titanium plate formed into a cylindrical shape having an inner diameter of 89 mm and a height of 100 mm. Also used as the cathode was a rod-shaped cathode having a circular cross-section made of metal molybdenum, metal titanium, or carbon steel. The surface of the cathode has a curved surface shape, more particularly, the cathode has a cylindrical shape.

For the arrangement of the anode and cathode in the electrolytic bath, the cylindrical anode was arranged such that the central axis thereof is substantially parallel to the depth direction of the molten salt bath, and the rod-shaped cathode was arranged at the center on the inner side of the cylindrical anode.

A pulsed current that repeated the electric conduction and the stop at predetermined intervals was passed through the anode and the cathode, thereby performing electrolysis to dissolve the anode and deposit metal titanium in the form of a foil on the cathode. Table 1 shows various conditions of Examples 1 to 7 and Comparative Examples 1 to 3.

Here, in each of Examples 1 to 7 and Comparative Example 3, as shown in Table 1, the pulse current was applied such that the average current density of the cathode was maintained at 0.01 A/cm$^2$ 0.09 A/cm$^2$, throughout the entire electric conduction period including the period from the start to 30 minutes later of the electric conduction. That is, the average current densities from the start to 30 minutes of the titanium deposition step and after 30 minutes are the same. On the other hand, in each of Comparative Examples 1 and 2, the average current density of the cathode was higher than 0.09 A/cm$^2$ throughout the entire electric conduction period including the period from the start to 30 minutes later of the electric conduction.

(Recovery of Metal Titanium)

At the end of electrolysis, the cathode was lifted up from the molten salt bath and washed with water to remove the molten salt adhering to the surface. In each of Examples 1 to 7 and Comparative Examples 1 to 3, metal titanium having a size equivalent to the surface area of the cathode immersed portion was deposited on the cathode. Further, in each of Examples 1 to 7 and Comparative Examples 1 to 3, metal titanium in the form of a foil was deposited on the cathode, and no hole was observed in the appearance of the metal titanium in the form of a foil.

A notch was then made in the dried metal titanium with a cutter, the notched portion of the metal titanium was grasped with tweezers and a hand, and an attempt was made to peel it off from the cathode by the force of the hand. A case where titanium could be peeled off by the hand was evaluated as higher separability, and a case where titanium could not be peeled off was evaluated as lower separability, which are shown in Table 1. The metal titanium in Examples evaluated as lower separability was recovered by dissolving the cathode with a mixed solution of nitric acid and sulfuric acid.

As can be seen from Table 1, on one hand, Examples 1 to 7 where the average current density of the cathode was maintained in the range of from 0.01 A/cm$^2$ to 0.09 A/cm$^2$ resulted in higher separability that could be peeled off by the hand, and on the other hand, Comparative Examples 1 and 2 where the average current density of the cathode was higher resulted in lower separability that could not be peeled off by the hand. Further, Comparative Example 3 where the temperature of the molten salt was higher also resulted in lower separability that could not be peeled off by the hand.

(Analysis of Metal Titanium)

For Example 1, oxygen in metal titanium was analyzed by infrared absorption method using dissolution of an inert gas. Further, for Example 1, iron in metal titanium was analyzed for the dissolved metal titanium by fluorescent X-ray analysis.

As a result, the oxygen concentration of the metal titanium obtained in Example 1 was 175 ppm by mass, and the iron concentration was 6 ppm by mass. Since the oxygen concentration of the anode made of metal titanium as a raw material was 700 ppm and the iron concentration was 600 ppm, it was confirmed that the metal titanium obtained in Example 1 had higher purity.

Example 8

Metal titanium was deposited on the cathode under the same conditions as those of Example 1, with the exception that after 30 minutes from the start of applying current (the start of the titanium deposition step), the average current density was 0.11 A/cm$^2$, which was more than 0.09 A/cm$^2$. As a result, as in Example 1, no hole was observed in the appearance of the metal titanium in the form of a foil even if it had a larger area, and the metal titanium exhibited higher separability.

TABLE 1

| | | Example 1 | Example 2 | Example 3 | Example 4 | Example 5 | Example 6 | Example 7 | Comparative Example 1 | Comparative Example 2 | Comparative Example 3 |
|---|---|---|---|---|---|---|---|---|---|---|---|
| Cathode Diameter | mm | 48 | 20 | 25 | 20 | 20 | 20 | 20 | 48 | 25 | 20 |
| Cathode Height | mm | 109 | 82 | 51 | 82 | 82 | 75 | 82 | 48 | 113 | 82 |
| Cathode Material | | Mo | Mo | Mo | Carbon Steel | Ti | Mo | Mo | Mo | Mo | Mo |
| Cathode Immersed Surface Area | mm2 | 16,400 | 5,150 | 4,040 | 5,150 | 5,150 | 4,710 | 5,150 | 7,210 | 8,940 | 5,150 |
| Distance between Electrodes | mm | 21 | 35 | 32 | 35 | 35 | 35 | 35 | 21 | 32 | 35 |
| Temperature of Molten Salt | ° C. | 520 | 520 | 520 | 520 | 520 | 520 | 520 | 520 | 520 | 700 |
| Current Condition | | Pulse | Pulse | Pulse | Pulse | Pulse | Pulse | Pulse | Pulse | Pulse | Pulse |
| Current Density at ON | | 0.108 | 0.150 | 0.115 | 0.150 | 0.150 | 0.150 | 0.050 | 0.226 | 0.201 | 0.150 |
| ON Time | | 1.5 s | 1.5 s | 1.5 s | 1.5 s | 1.5 s | 1.5 s | 1.5 s | 1.5 s | 1.5 s | 1.5 s |
| Current Density at OFF | | 0 | 0 | 0 | 0 | 0 | 0 | 0 | 0 | 0 | 0 |
| OFF Time | | 1.5 s | 1.5 s | 1.5 s | 1.5 s | 1.5 s | 1.5 s | 1.5 s | 1.5 s | 1.5 s | 1.5 s |
| Average Current Density | A/cm2 | 0.054 | 0.075 | 0.058 | 0.075 | 0.075 | 0.075 | 0.025 | 0.113 | 0.101 | 0.075 |
| Form of Titanium | | Foil | Foil | Foil | Foil | Foil | Foil | Foil | Foil | Foil | Foil |
| Average Thickness of Titanium | μm | 102 | 100 | 40 | 100 | 100 | 235 | 105 | 69 | 114 | 100 |
| Titanium Separability | | Higher | Higher | Higher | Higher | Higher | Higher | Higher | Lower | Lower | Lower |

Comparative Example 4

Metal titanium was deposited on the cathode under the same conditions as those of Example 1, with the exception that after 27 minutes from the start of applying current (the start of the titanium deposition step), the average current density was 0.11 A/cm$^2$, which was more than 0.09 A/cm$^2$. As a result, although no hole was observed in the appearance of the obtained metal titanium in the form of a foil, the metal titanium showed lower separability that could not be peeled off by the hand.

The invention claimed is:

1. A method for producing metal titanium by carrying out electrolysis using an anode and a cathode in a molten salt bath, the method comprising:

a titanium deposition step of depositing metal titanium on the cathode, wherein, in the titanium deposition step, a temperature of the molten salt bath is from 250° C. or more and 600° C. or less, and an average current density of the cathode in a period from the start to 30 minutes later of the titanium deposition step is maintained in a range of from 0.01 A/cm$^2$ to 0.09 A/cm$^2$, and a titanium separation step of mechanically separating the metal titanium deposited on the cathode from the cathode after the titanium deposition step, wherein the metal titanium is produced in the form of a sheet having a thickness of from 20 μm to 1000 μm, wherein at least a surface of the cathode is made from metal titanium, and wherein the anode contains metal titanium.

2. The method according to claim 1, wherein in the titanium deposition step, a surface area of a cathode immersed portion that is immersed in the molten salt bath is 3000 mm$^2$ or more.

3. The method according to claim 1, wherein a surface of the cathode on which metal titanium is deposited in the titanium deposition step has a curved surface shape.

4. The method according to claim 3, wherein the cathode has a cylindrical shape.

5. The method according to claim 1, wherein the molten salt bath contains at least two selected from the group consisting of $MgCl_2$, NaCl, KCl, $CaCl_2$, LiCl, alkali metal iodides, and alkali metal bromides.

6. The method according to claim 5, wherein the molten salt bath contains 80 mol % or more of at least two selected from the group consisting of $MgCl_2$, NaCl, KCl, $CaCl_2$, and LiCl.

7. The method according to claim 1, wherein the molten salt bath contains from 3 mol % to 12 mol % of $TiCl_2$.

8. The method according to claim 1, wherein the molten salt bath does not contain $BaCl_2$.

9. The method according to claim 1, wherein the cathode contains 70% by mass or more of Ti, Mo, or Fe.

10. The method according to claim 1, further comprising an anode dissolving step of dissolving the anode by electrolysis in the molten salt bath prior to the titanium deposition step.

11. The method according to claim 1, wherein in the titanium deposition step, the average current density of the cathode after the period is changed and maintained in a range of 0.01 A/cm$^2$ to 5.00 A/cm$^2$.

12. The method according to claim 1, wherein the anode comprises titanium sponge, a titanium rod, and/or a titanium plate.

* * * * *